US005311264A

United States Patent [19]

Kinoshita

[11] Patent Number: 5,311,264

[45] Date of Patent: May 10, 1994

[54] DEVELOPING APPARATUS FOR DEVELOPING ELECTROSTATIC LATENT IMAGE USING ONE COMPONENT DEVELOPER

[75] Inventor: Masahide Kinoshita, Yokohama, Japan

[73] Assignee: Canon Kabushiki Kaisha, Tokyo, Japan

[21] Appl. No.: 36,269

[22] Filed: Mar. 24, 1993

[30] Foreign Application Priority Data

Mar. 24, 1992 [JP] Japan ..... 4-096027

[51] Int. Cl.[5] ..... G03G 15/06

[52] U.S. Cl. ..... 355/259; 118/653; 118/661; 355/245

[58] Field of Search ..... 355/245, 259, 246, 250, 355/251, 253; 118/653, 656, 661, 658; 492/17, 18

[56] References Cited

U.S. PATENT DOCUMENTS 4,835,059 5/1989 Tomura et al. ..... 355/259 X
5,086,728 2/1992 Kinoshita ..... 118/653
5,170,213 12/1992 Yamaguchi et al. ..... 355/245 X
5,177,323 1/1993 Kohyama ..... 118/653
5,210,575 5/1993 Kikuchi ..... 355/259
5,245,391 9/1993 Suzuki et al. ..... 355/259 X

FOREIGN PATENT DOCUMENTS 58-116559 7/1983 Japan .

*Primary Examiner*—Matthew S. Smith
*Attorney, Agent, or Firm*—Fitzpatrick, Cella, Harper & Scinto

[57] ABSTRACT

A developing apparatus for developing an electrostatic latent image includes a container for containing a one component developer; a rotatable developer carrying member for carrying the one component developer and for supplying the developer to an electrostatic latent image bearing member; and a rotatable elastic roller, rotatable in contact with the developer carrying member, for applying the one component developer contained in the container to the developer carrying member; wherein an elastic layer of the elastic roller in contact with the developer carrying member is composed of a closed-cell foamed rubber, and has a density of 0.18 g/cm$^3$–0.28 g/cm$^3$.

5 Claims, 5 Drawing Sheets

DEVELOPING APPARATUS FOR DEVELOPING ELECTROSTATIC LATENT IMAGE USING ONE COMPONENT DEVELOPER

FIELD OF THE INVENTION AND RELATED ART

The present invention relates to a developing apparatus for developing an electrostatic latent image using a one component developer in an electrophotographic apparatus, an electrostatic recording machine or the like.

In a known developing apparatus using one component developer, a roller-like developer supply member is used as a developer carrying member for carrying the one component developer and conveying it to the developing position, where the developer is applied.

An example of such developing apparatus is disclosed in Japanese Laid-Open Patent Application No. 116559/1983. As shown in FIG. 1, the developing apparatus is provided with an opening which faces an electrophotographic photosensitive drum 1. The developing apparatus comprises a developer container 2 for accommodating a non-magnetic toner 6 functioning as the one component non-magnetic developer, a rotatable developing sleeve 3, disposed in the developer container 2, for carrying the non-magnetic toner 6 and conveying it to the photosensitive drum 1, an elastic blade 4, contacted to an outer surface of the developing sleeve 3, for regulating a thickness of the layer of non-magnetic toner carried on the developing sleeve, and a rotatable supply roller 15, disposed in the developer container 2, for supplying and applying the non-magnetic toner 6 onto the developing sleeve 3. The supply roller 15 is of a fur brush structure, and the outer peripheral surface of the developing sleeve 3 is contacted by the brush tips of the roller 15. During the developing operation, the developing sleeve 3 and the toner supplying roller 15 are rotated in the directions indicated by arrows, respectively. The non-magnetic toner 6 is supplied and applied to the developing sleeve 3 by the supply roller 15.

The developing sleeve 3 conveys the non-magnetic toner 6 thereon to the photosensitive drum. During the conveying operation, the thickness of the layer of non-magnetic toner 6 carried on the developing sleeve 3 is regulated to a predetermined thickness by the blade 4, and the non-magnetic toner 6 receives sufficient triboelectric charge. The layer of non-magnetic toner 6 regulated to the predetermined thickness and supplied with the triboelectric charge, is conveyed to a developing zone formed between the photosensitive drum 1 and the developing sleeve 3, and the non-magnetic toner 6 is transferred to a latent image formed on the photosensitive drum 1. The latent image is developed in this manner.

The non-magnetic toner 6 not transferred to the photosensitive drum 1 and remaining on the developing sleeve 3 is scraped off the developing sleeve 3 by the supply roller 15 after returning into the container 2. Then, the developing sleeve 3 is supplied with fresh non-magnetic toner 6 by the supply roller 15. In this manner, the occurrence of variations in the density of the toner image, such as a ghost image, can be avoided.

U.S. Pat. No. 5,086,728 discloses the use of a roller having an open-cell foamed rubber layer, as the supply roller. Since the surface of the supply roller comprising such an open-cell foamed rubber has a proper roughness, the supply of the developer to the developing sleeve 3 and the scraping off of the remaining developer from the developing sleeve 3 are carried out by the roughness of the surface of the toner supplying roller. However, in a developing apparatus using the fur brush supply roller 15, the toner collects in the brush over time, and the brush of the supply roller becomes hardened. In particular, when a small particle size toner is used under high temperature and high humidity conditions, the hardening of the brush of the supply roller occurs easily.

In a developing apparatus using a supply roller made of an open-cell foamed material, the toner collects in the pores of the supply roller over time of, and the toner supply roller becomes hardened.

As a result of the hardening of the supply roller, the contact pressure of the supply roller to the developing sleeve increases. Accordingly the toner is fused on the developing sleeve, the toner is deteriorated, and the driving torques for the developing sleeve and the supply roller increase.

Additionally, the hardening of the supply roller is not uniform in the longitudinal direction of the supply roller. Therefore, the toner is not uniformly supplied to the developing sleeve or scraped off the developing sleeve, by such a hardened supply roller. Accordingly, the triboelectric charge of the toner on the developing sleeve is non-uniform, and the toner layer thickness on the developing sleeve is non-uniform.

Collection of the toner in the pores of the open-cell foamed rubber can be prevented by the provision of a non-foamed rubber surface layer on the open-cell foamed rubber. However, this results in an increase in the contact area of the surface layer of the roller to the developing sleeve, and therefore, an increase in the friction between the roller and the developing sleeve. Accordingly, the toner is fused on the developing sleeve, the toner is deteriorated, and the driving torques for the developing sleeve and the roller increase. In order to decrease the contact area between the surface rubber layer of the roller and the developing sleeve, U.S. Pat. No. 5,086,728 discloses a certain degree of roughness formed on the surface of the rubber layer of the roller. However, the hardness of the rubber layer of the roller is locally high as compared with the surface of the foamed material in the initial state, and therefore, a foggy background is produced due to deterioration of the toner, and manufacturing is difficult.

U.S. Pat. No. 5,086,728 discloses a supply roller made of a closed-cell roller used as the supply roller. In this case, a proper roughness of the surface of the roller is effective to perform proper toner supply and scraping for the developing sleeve. In addition, hardening of the roller due to collection of the toner in the pores can be prevented. However, if the density of the roller is too high, it has been found that there arises the same problem as when the roller of the open-cell foamed material is hardened.

On the other hand, if the density of the roller is too low, the low molecular weight component is significantly contained in order to decrease the density of the roller, and therefore, the low molecular weight component seeps out when the roller is driven. For this reason, with use over time the elasticity of the roller decreases. If this occurs, then the contact between the roller and the developing sleeve becomes improper, the toner supply to the developing sleeve becomes insufficient, and the scraping of the toner from the developing sleeve is insufficient. Accordingly, the reproducibility of a black image becomes difficult.

When a roller having too low a density is used as a supply roller, the deposition of the low molecular weight component of the rubber on the developing sleeve results in the incapability of sufficient triboelectric charge application to the toner newly supplied to the developing sleeve. Therefore, a foggy background is produced. A closed-cell material means a material in which adjacent pores are not in fluid communication with each other.

SUMMARY OF THE INVENTION

Accordingly, it is a principal object of the present invention to provide a developing apparatus in which one component developer is properly applied on a developer carrying member.

It is another object of the present invention to provide a developing apparatus in which hardening of the elastic roller over time of use is effectively prevented, so that the one component developer is properly applied on the developer carrying member for a long period of time.

It is a further object of the present invention to provide a developing apparatus in which the hardening of an elastic roller over time of use, is effectively prevented, to prevent fusing of the one component developer on the developer carrying member and deterioration of the one component developer.

It is a yet further object of the present invention to provide a developing apparatus in which contamination of the developer carrying member with the low molecular weight component of the rubber can be avoided, because such contamination results in insufficient triboelectric charging of the one component developer.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
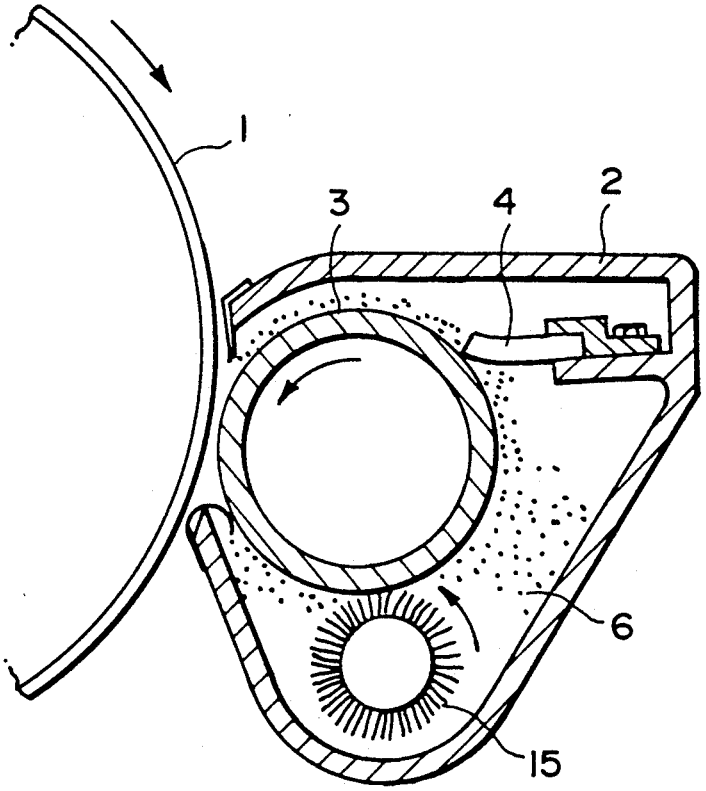
FIG. 1 is a sectional view of a conventional developing apparatus.
Figure 2:
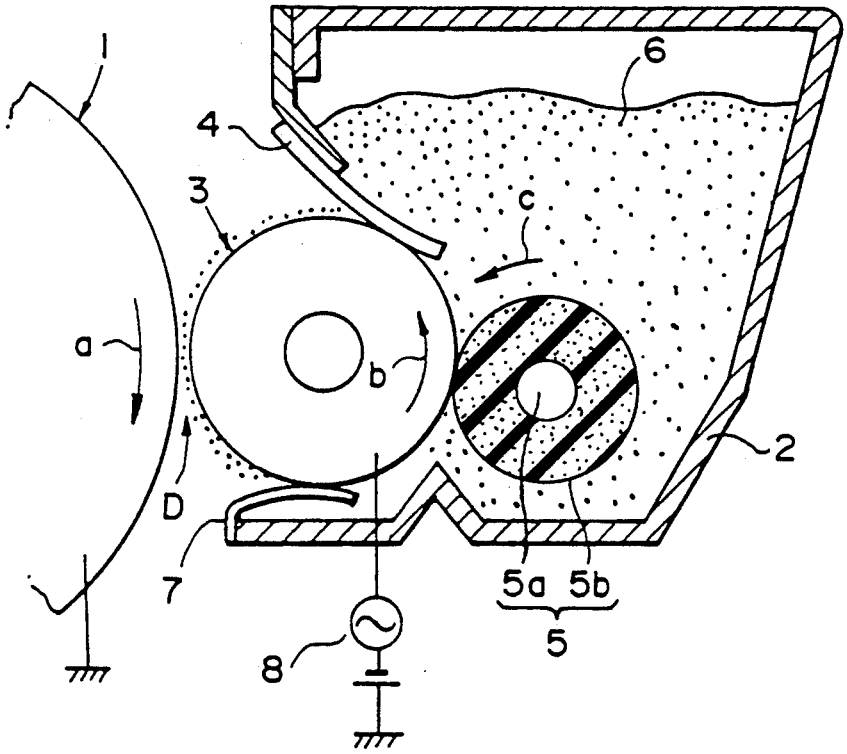
FIG. 2 is a sectional view of a developing apparatus according to an embodiment of the present invention.

Referring to FIG. 2, there is shown a developing apparatus provided with an opening faced to an electrophotographic photosensitive drum 1 rotating in a direction indicated by an arrow a, and provided with a developer container 2 for containing non-magnetic toner (one component non-magnetic developer) 6. The non-magnetic toner 6 comprises styrene resin, acrylic resin, polyethylene resin or another thermoplastic resin, and pigment dispersed in the resin material.

The developer container 2 is provided with a rotatable developing sleeve 3 for carrying the non-magnetic toner 6 to a developing zone D for supplying the toner to the photosensitive drum 1. The developing sleeve 3 is rotatable in a direction indicated by an arrow b (the sleeve 3 may be in the form of a solid roller). The developing sleeve 3 is disposed in the developer container 2 so that a part of its outer peripheral surface is exposed through the opening of the container 2. In the illustrated example, the developing sleeve 3 is made of an aluminum sleeve having a diameter of 16 mm. The outer surface of the developing sleeve 3 has been blast-treated with glass beads to a surface roughness Rz of approx. 3 microns.

The developer container 2 is provided with an elastic blade 4 to limit a thickness of the layer of non-magnetic toner 6 to be conveyed to the developing zone D by the developing sleeve 3. The blade 4 is made of silicone rubber, urethane rubber or another rubber material (the hardness thereof is 40–90 degrees (JIS-A)). In this embodiment, the blade 4 is composed of a urethane rubber material, the thickness thereof is 1.2 mm, and the hardness of the blade 4 is 65 degrees. The blade 4 is disposed at an upper position of the developing sleeve 3. The surface of the blade 4 adjacent to its end is contacted to the outer surface of the developing sleeve 3, while the blade 4 is elastically deformed into an arc.

The contact pressure between the blade 4 and the developing sleeve 3 is represented by a line pressure along an axis of the developing sleeve 3. It is preferable that the line pressure is 5–200 g/cm. In this embodiment, it is 50 g/cm. As for the method of measuring the line pressure, three thin plates having known friction coefficients are overlaid, the three thin plates are inserted into a nip formed between the blade 4 and the developing sleeve 3, and the central thin plate is pulled through a spring balance. The line pressure is determined on the basis of the pulling force and the friction coefficients. Through this method, the line pressure between the blade 4 and the developing sleeve 3 is determined.

In this embodiment, the blade 4 effectively regulates the thickness of the layer of toner on the developing sleeve such that the thickness of the toner layer is smaller than the minimum gap between the sleeve 3 and the drum 1. In other words, so-called non-contact development is carried out.

An elastic toner supply roller 5 is mounted on the developer container 2 for rotation in a direction indicated by an arrow c (the same rotational direction as the one indicated by an arrow b) and effectively supplies and applies the non-magnetic toner 6 to the developing sleeve 3, and scrapes the non-magnetic toner 6 off the surface of the developing sleeve after it passes through the developing zone D. The elastic roller 5 comprises a shaft **5*a* and an elastic layer 5*b* thereon. The elastic layer 5*b* is press-contacted to the sleeve 3**, and is made of a closed-cell foamed material such as silicone rubber, EPDM rubber or CR rubber.

In this embodiment, the diameter of the toner supply roller 5 is 12 mm, the diameter of the shaft **5*a* is 4 mm, and the thickness of the elastic layer 5*b* is 4 mm. The density of the elastic layer 5*b* is 0.25 g/cm$^3$. The compression deformation $\delta$ at the contact portion between the elastic layer 5*b* and the developing sleeve 3** in a radial direction is 1.0 mm.

The compression deformation $\delta$ of the elastic layer **5*b*** is defined as follows:

$$\delta=(R1+R2)-A$$

where R1 is a radius of the developing sleeve 3, R2 is a radius of the elastic roller 5, and A is a distance between axes of the developing sleeve 3 and the elastic roller 5.

The radius R2 of the elastic roller 5 is the one measured when it is not press-contacted with the sleeve 3.

Thus, the compression deformation δ is a maximum of the radial deformation of the elastic roller 5 at the contact portion with the developing sleeve 3.

With an increase in the compression deformation δ, a width (measured in the sleeve rotational direction) of a nip formed between the developing sleeve and the elastic roller 5 increases, and therefore, the contact force increases.

The developer container 2 is provided with a lower sealing member 7 to prevent the non-magnetic toner 6 from leaking out through a gap existing between the developer container 2 and the developing sleeve 3. The lower sealing member 7 is disposed at a bottom portion of the developer container 2. The sealing member 7 is elastically deformed into an arc while being in contact with the outer surface of the developing sleeve 3.

During the developing operation, the developing sleeve 3 and the elastic roller 5 are rotated in the directions b and c, respectively. The non-magnetic toner is supplied and applied to the developing sleeve 3 by the elastic roller 5. The developing sleeve 3 carries the non-magnetic toner 6 to the developing zone D. During the conveyance of the toner by the sleeve 3, the thickness of the non-magnetic toner layer on the developing sleeve 3 is regulated to a predetermined layer thickness by the blade 4, and the non-magnetic toner 6 is triboelectrically charged by friction with the sleeve 3 to a degree sufficient for developing the electrostatic latent image.

The developing sleeve 3 is supplied with an oscillating bias voltage in the form of a DC biased AC voltage, the DC voltage component having a level between an image portion potential and a background portion potential of the electrostatic latent image. By voltage application, an oscillating electric field is formed in the developing zone D, by which the toner is transferred from the developing sleeve 3 to the image portion potential portion of the latent image, thus developing the electrostatic latent image.

The non-magnetic toner 6 remaining on the developing sleeve 3 without being transferred onto the photosensitive drum 1 in the developing zone, is scraped off the developing sleeve 3 by the elastic roller 5, after returning into the container 2 with rotation of the developing sleeve 3. Then, the developing sleeve 3 is supplied with new non-magnetic toner by the elastic roller 5.

The image formation tests of the above-described developing apparatus will be described. In these tests, the above-described developing apparatus was incorporated in a copying machine FC-1 available from Canon Kabushiki Kaisha, Japan, and the image forming operation was carried out in the copying machine. In this copying machine, the surface potential of the electrostatic latent image of the photosensitive drum 1 was set to −600 V at a dark portion potential (image portion), and −150 V at a light portion potential (background). The developing bias applied to the developing sleeve 3 was in the form of an AC voltage having a frequency of 1800 Hz and a peak-to-peak voltage of 1200 V biased with a DC voltage of −150 V. The peripheral speed of the elastic roller 5 was 50 mm/sec; a peripheral speed of the developing sleeve 3 was 70 mm/sec; and a clearance or gap between the photosensitive drum 1 and the developing sleeve 3 was approx. 250 microns. The peripheral speed of the photosensitive drum 1 was 50 mm/sec.

The results of the tests are as follows. A uniform toner layer having a thickness of approx. 30 microns was formed on the developing sleeve 3, and the charge amount of the toner was +15 μC/g, which is proper. The reflection density of the resultant image was 1.3, which is also proper. In continuous image formation for 2000 transfer sheets, the elastic roller was not hardened; the toner was not fused on the developing sleeve 3; the developing sleeve 3 was not contaminated due to seeping-out of the low molecular weight component of the rubber; the driving torque for the elastic roller was not increased; and satisfactory images were provided on the respective transfer sheets without any density non-uniformity or foggy background.

In this embodiment, the density of the elastic layer 5*b* was 0.25 g/cm$^3$, and the compression deformation δ of the elastic layer 5*b* relative to the developing sleeve 3 was 1.0 mm. The same advantageous effects can be provided by other proper combinations of the density and the compression deformation.

Figure 3:
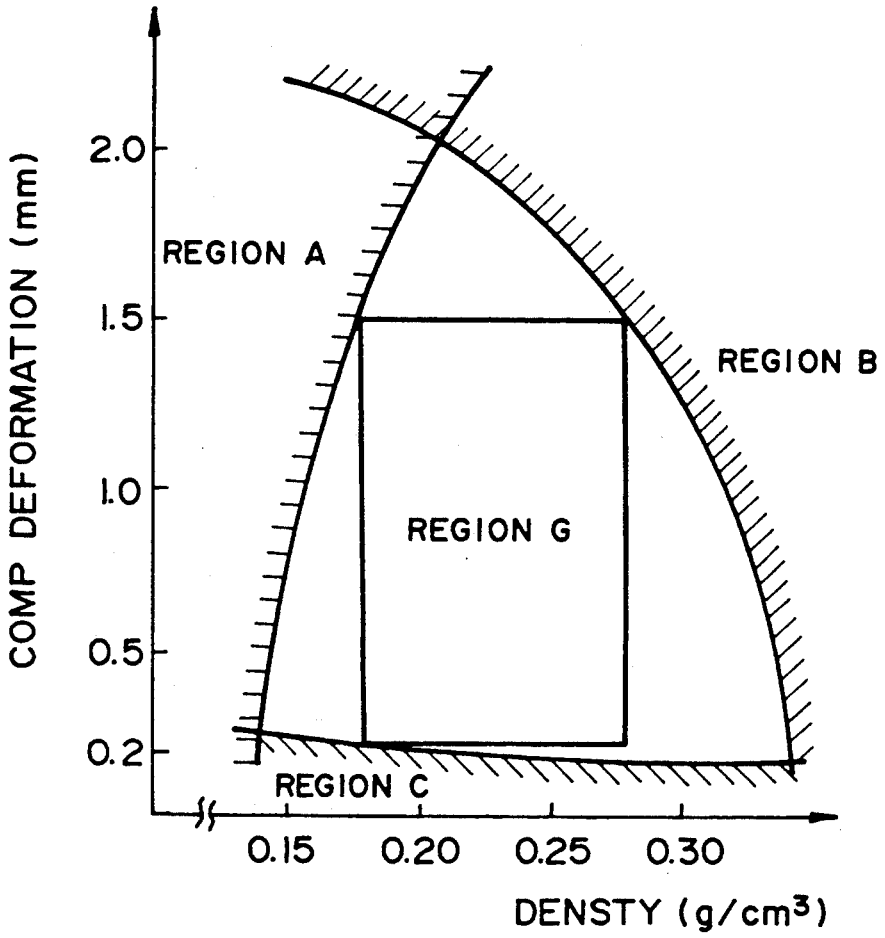
FIG. 3 is a graph showing a relation between the density of an elastic roller and a compression deformation thereof.

FIG. 3 is a graph showing the relationship between the density (g/cm$^3$) of a closed-cell foamed rubber layer 5*b* and the compression deformation δ (mm) at the contact portion between the rubber layer 5*b* and the sleeve 3. In this Figure, a region A is a region in which the developing sleeve is contaminated due to seeping of the low molecular weight component of the rubber; region C is a region in which image density non-uniformity occurs due to non-uniform pressure-contact between the toner supply roller and the developing sleeve; and region B is a region in which the toner is fused on the developing sleeve, the toner is deteriorated, and the driving torque in increased. As will be understood from these regions, it is preferable that the density of the elastic layer 5*b* of the elastic roller 5 is 0.18 g/cm$^3$–0.28 g/cm$^3$, and that the compression deformation of the elastic layer relative to the developing sleeve 3 is 0.2 mm–1.5 mm.

A rectangular region G of FIG. 3 is a preferable region in which the problems in the regions A, B and C can be avoided.

Figure 4:
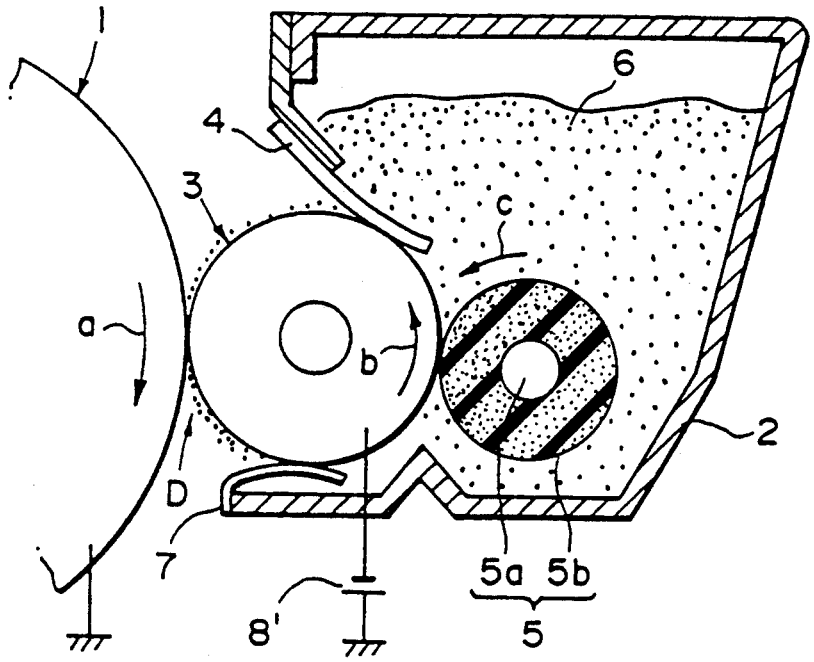
FIG. 4 is a sectional view of a developing apparatus according to another embodiment of the present invention.

Referring to FIG. 4, there is shown a developing apparatus in which in place of the developing sleeve 3 of the developing apparatus of FIG. 2, a developing sleeve 3 is used which is in contact with the photosensitive drum 1.

The developing sleeve 3 is made of an intermediate resistance high polymer elastic material such as neoprene rubber in which electrically conductive material such as carbon black is dispersed. The surface thereof is formed with a proper roughness.

The elastic roller 5 comprises a shaft 5*a* and elastic layer 5*b*, and the elastic layer 5*b* is composed of a closed-cell foamed material, such as a rubber material, as described in the foregoing. The density of the elastic layer 5*b* of the roller 5 is 0.18 g/cm$^3$–0.28 g/cm$^3$. An Asker C hardness of the elastic layer 5*b* is 8–20 degrees. The compression deformation δ, in a radial direction, of the elastic layer 5*b* at the position of contact with the developing sleeve 3, is 0.2–1.5 mm.

In an image forming apparatus using this developing apparatus, the developing bias applied to the developing sleeve 3 from a voltage source 8′ comprises only a DC component. The peripheral speed of the photosensitive drum 1 is 50 mm/sec, and the peripheral speed of the developing sleeve 3 is 100 mm/sec.

Also in this embodiment, at the contact portion between the elastic roller 5 and the developing sleeve 3, the load of the sliding contact applied to the non-magnetic toner 6 is small. Therefore, fusing of the non-magnetic toner 6 on the developing sleeve 3, deterioration of the non-magnetic toner 6 and increase of in the developing sleeve driving torque can be prevented. In addition, contamination of the photosensitive drum 1 due to deposition of the low molecular weight component of the rubber can be prevented. As a result, satisfactory images without foggy backgrounds can be stably provided.

In the foregoing embodiments, the elastic roller 5 is disposed upstream of a toner layer thickness regulating blade 4 with respect to the rotational direction of the developing sleeve. In a developing apparatus as shown in FIG. 5, the elastic roller 5 is disposed at a position of an outlet through which the toner is fed out of the container 2 by the developing sleeve 3.

Figure 5:
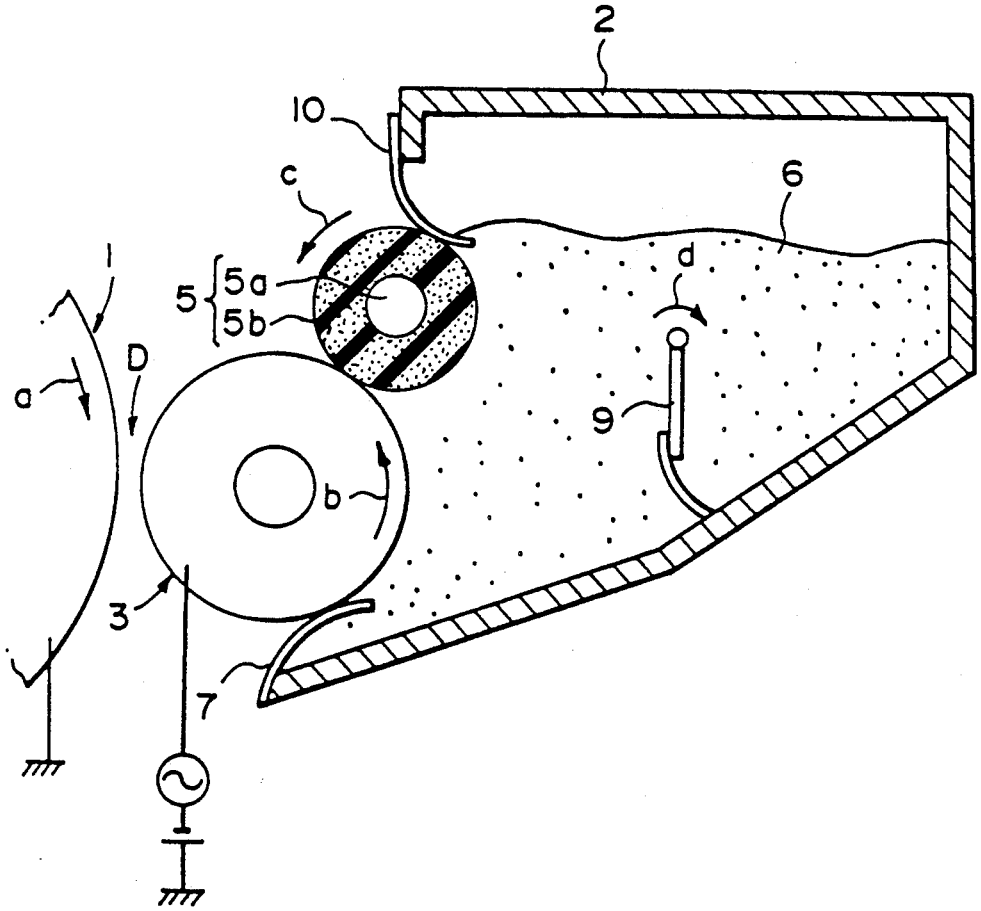
FIG. 5 is a sectional view of a developing apparatus according to a further embodiment of the present invention.

In the developing apparatus of FIG. 5, there are provided conveying means 9, disposed in the developer container 2, for conveying the non-magnetic toner 6 to the elastic roller 5, and an elastic blade 10, in contact with the outer peripheral surface of the elastic roller 5, for regulating a toner layer thickness of the non-magnetic toner 6 fed by the elastic layer 5 to a portion press-contacted to the sleeve 3.

The elastic roller 5 comprises a shaft **5*a* and an elastic layer 5*b*, wherein the elastic layer 5*b* is made of a closed-cell foamed material, such as rubber, as described in the foregoing. The density of the elastic layer 5*b* of the toner supply roller 5 is 0.18 g/cm$^3$–0.28 g/cm$^3$. A number of cells per unit length in the surface of the elastic layer 5*b* is 100/inch or more. The compression deformation $\delta$ in a radial direction at the position of contact between the elastic layer 5*b* and the developing sleeve 3** is 0.2–1.5 mm.

The blade 10 is made of elastic plate of stainless steel or PET. The blade 10 and the elastic roller 5 cooperate with each other to regulate the layer thickness of the non-magnetic toner 6 on the developing sleeve 3.

When the non-magnetic toner 6 is supplied to the developing sleeve 3 from the elastic roller 5, the non-magnetic toner 6 is transferred to the developing sleeve 3 while being rubbed in the contact portion between the elastic roller 5 and the developing sleeve 3. The density of the elastic layer **5*b* is 0.18 g/cm$^3$–0.28 g/cm$^3$; the compression deformation $\delta$ of the elastic layer 5*b* in the radial direction at the contact portion between the developing sleeve and the elastic layer 5*b* is 0.2 mm–1.5 mm. By this method, the thickness of the layer of non-magnetic toner 6 supplied to the developing sleeve 3 can be controlled to the proper level, and a sufficient triboelectric charge can be applied to the non-magnetic toner 6. In addition, since the number of cells per unit length in the surface of the elastic layer 5*b* is not less than 100/inch, the layer of the non-magnetic toner 6 on the plastic layer 5*b* after being regulated by the blade 10** is free from fine stripes. Therefore, a uniform toner image can be provided.

Under a high temperature and high humidity ambient condition, the toner is not easily triboelectrically charged. Accordingly, a decrease in image density or a foggy background easily may occur.

In view of this, the elastic layer **5*b* of the elastic roller 5 preferably is made of a rubber material which is charged by friction with the toner to a polarity opposite the triboelectric charging polarity of the toner. In this manner, the toner is triboelectrically charged to the polarity for developing the electrostatic latent image by the friction with the elastic roller 5 as well as by the friction with the sleeve 3**. Therefore, the toner can be triboelectrically charged to a sufficient extent even under high temperature and high humidity conditions.

When, for example, the non-magnetic toner 6 comprises a copolymer of styrene/acrylic resin and styrene-butadiene resin, positive polarity control agent (fourth class ammonium salt) and pigment, and has an average particle size of 8 microns, and colloidal silica (1.0%) is applied thereto (with a positive charging polarity), the elastic roller 25 may have an elastic layer **5*b* of a closed-cell foamed material such as silicone rubber, EPDM rubber, NR rubber or the like, with a charging polarity (negative) opposite the charging polarity of the non-magnetic toner 6. Such a toner and elastic roller were used in the developing apparatus of FIG. 2, and continuous image forming operations were carried out for 2000 transfer materials, using the copying machine FC-5 under a high temperature and high humidity condition (35° C., 90% RH). The triboelectric charge applied to the non-magnetic toner 6** on the developing sleeve, and the image quality on the transfer material, were evaluated.

Upon completion of the image forming operation on the 2000th, the triboelectric charge of the non-magnetic toner 6 on the developing sleeve 3 were +13 $\mu$C/g, which is proper. Faithful and proper images were formed on the respective transfer materials.

In the apparatus of FIGS. 4 and 5, the triboelectric charging polarity of the elastic roller 5 may be opposite that of the toner. In this manner, a sufficient amount of triboelectric charge can be provided even under high temperature and high humidity conditions.

In the foregoing, an example has been described in which a one component non-magnetic developer is used. However, the present invention is applicable to a developing apparatus using a one component magnetic developer. In this case, the developing sleeve is a non-magnetic sleeve, and a magnet is disposed therein.

In addition, the present invention is applicable to an apparatus in which a reverse-development process is carried out, e.g., in which the latent image is developed with a toner charged to the same polarity as the latent image.

While the invention has been described with reference to the structures disclosed herein, it is not confined to the details set forth. This application is intended to cover such modifications or changes as may come within the purposes of the improvements or the scope of the following claims.

What is claimed is:

1. A developing apparatus for developing an electrostatic latent image, comprising:

a container for containing a one component developer;

a rotatable developer carrying member for carrying the one component developer and for supplying the developer to an electrostatic latent image bearing member; and a rotatable elastic roller, rotatable in contact with said developer carrying member, for applying the one component developer contained in said container to said developer carrying member;

wherein an elastic layer of said elastic roller in contact with said developer carrying member is composed of a closed-cell foamed rubber, and has a density of 0.18 g/cm$^3$–0.28 g/cm$^3$.

2. A developing apparatus according to claim 1, wherein a compression deformation of said elastic roller at a contact portion between said developer carrying member and said elastic roller is 0.2–1.5 mm.

3. An apparatus according to claim 1, further comprising a regulating member for regulating a thickness of a layer of the one component developer to be fed to a developing zone by said developer carrying member, and disposed at a position downstream of a contact portion between said elastic roller and said developer carrying member with respect to a rotational direction of said developer carrying member.

4. An apparatus according to claim 1, wherein said elastic roller is disposed adjacent an exit of said container for said developer carrying member.

5. An apparatus according to any one of claims 1–4, wherein a triboelectric charging polarity of said elastic roller is opposite that of the one component developer.

* * * * *

UNITED STATES PATENT AND TRADEMARK OFFICE

CERTIFICATE OF CORRECTION

PATENT NO. : 5,311,264

DATED : May 10, 1994

INVENTOR(S) : KINOSHITA

It is certified that error appears in the above-indentified patent and that said Letters Patent is hereby corrected as shown below: Title page:

Item [56]: References Cited

Change "4,835,059 5/1989 Tomura et al." to --4,833,059 5/1989 Tomura et al.--.

Column 2

Line 14, change "time of," to --time,--.

Column 8

Line 32, change "were" to --was--.

Signed and Sealed this

Eleventh Day of October, 1994

Bruce Lehman

*Attest:*

*Attesting Officer*

BRUCE LEHMAN

*Commissioner of Patents and Trademarks*